US010242818B2

(12) United States Patent
Chen et al.

(10) Patent No.: US 10,242,818 B2
(45) Date of Patent: Mar. 26, 2019

(54) KEY STRUCTURE EMPLOYING A DOME AND SCISSOR-TYPE SUPPORT

(71) Applicant: Primax Electronics Ltd., Taipei (TW)

(72) Inventors: Bo-An Chen, Taipei (TW); Chin-Sung Pan, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 15/706,038

(22) Filed: Sep. 15, 2017

(65) Prior Publication Data

US 2018/0308646 A1 Oct. 25, 2018

(30) Foreign Application Priority Data

Apr. 21, 2017 (TW) ..... 106113493 A

(51) Int. Cl.

| | |
|---|---|
| ***H01H 3/12*** | (2006.01) |
| ***H01H 13/10*** | (2006.01) |
| ***H01H 13/14*** | (2006.01) |
| ***H01H 13/50*** | (2006.01) |
| ***H01H 13/7065*** | (2006.01) |

(52) U.S. Cl.

CPC ..... *H01H 13/14* (2013.01); *H01H 3/125* (2013.01); *H01H 13/10* (2013.01); *H01H 13/50* (2013.01); *H01H 13/7065* (2013.01); *H01H 2215/004* (2013.01); *H01H 2233/07* (2013.01)

(58) Field of Classification Search

CPC ..... H01H 3/125; H01H 2215/004; H01H 2215/006; H01H 2227/022; H01H 13/7065

USPC ..... 200/344, 345

See application file for complete search history.

(56) References Cited

U.S. PATENT DOCUMENTS 6,894,626 B2 * 5/2005 Olodort ..... G06F 3/0221 341/22

8,450,626 B2 * 5/2013 Yang ..... H01H 3/125 200/344

* cited by examiner

*Primary Examiner* — Vanessa Girardi

(74) *Attorney, Agent, or Firm* — Muncy, Geissler, Olds & Lowe, P.C.

(57) ABSTRACT

A key structure includes a switch circuit board, a triggering assembly, a keycap and an elastic element. The triggering assembly is disposed over the switch circuit board. The elastic element is arranged between the keycap and the triggering assembly. As the keycap is moved, the triggering assembly is pushed by the elastic element. The elastic element includes a concave part. The concave part is located at a top end of the elastic element and contacted with the keycap. When the elastic element is pushed by the keycap, the concave part is subjected to deformation, so that a movable distance of the keycap toward the switch circuit board is increased. By using the key structure, the tactile feel of depressing the keycap is enhanced.

10 Claims, 6 Drawing Sheets

KEY STRUCTURE EMPLOYING A DOME AND SCISSOR-TYPE SUPPORT

FIELD OF THE INVENTION

The present invention relates to a key structure, and more particularly to a key structure with a scissors-type connecting element.

BACKGROUND OF THE INVENTION

Generally, the widely-used peripheral input device of a computer system includes for example a mouse, a keyboard, a trackball, or the like. Via the keyboard, characters or symbols can be directly inputted into the computer system. As a consequence, most users and most manufacturers of input devices pay attention to the development of keyboards. As known, a keyboard with scissors-type connecting elements is one of the widely-used keyboards.

Hereinafter, a key structure with a scissors-type connecting element of a conventional keyboard will be illustrated with reference to FIG. 1. FIG. 1 is a schematic side cross-sectional view illustrating a conventional key structure. As shown in FIG. 1, the conventional key structure 1 comprises a keycap 11, a scissors-type connecting element 12, a rubbery elastomer 13, a membrane switch circuit member 14 and a base 15. The keycap 11, the scissors-type connecting element 12, the rubbery elastomer 13 and the membrane switch circuit member 14 are supported by the base 15. The scissors-type connecting element 12 is used for connecting the base 15 and the keycap 11.

The scissors-type connecting element 12 is arranged between the base 15 and the keycap 11, and the base 15 and the keycap 11 are connected with each other through the scissors-type connecting element 12. The scissors-type connecting element 12 comprises a first frame 121 and a second frame 122. A first end of the first frame 121 is connected with the keycap 11. A second end of the first frame 121 is connected with the base 15. The rubbery elastomer 13 is enclosed by the scissors-type connecting element 12. The membrane switch circuit member 14 comprises plural key intersections (not shown). When one of the plural key intersections is triggered, a corresponding key signal is generated. The rubbery elastomer 13 is disposed on the membrane switch circuit member 14. Each rubbery elastomer 13 is aligned with a corresponding key intersection. When the rubbery elastomer 13 is depressed, the rubbery elastomer 13 is subjected to deformation to push the corresponding key intersection of the membrane switch circuit member 14. Consequently, the corresponding key signal is generated.

The operations of the conventional key structure 1 in response to the depressing action of the user will be illustrated as follows. Please refer to FIG. 1 again. When the keycap 11 is depressed, the keycap 11 is moved downwardly to push the scissors-type connecting element 12 in response to the depressing force. As the keycap 11 is moved downwardly relative to the base 15, the keycap 11 pushes the corresponding rubbery elastomer 13. At the same time, the rubbery elastomer 13 is subjected to deformation to push the membrane switch circuit member 14 and trigger the corresponding key intersection of the membrane switch circuit member 14. Consequently, the membrane switch circuit member 14 generates a corresponding key signal. When the keycap 11 is no longer depressed by the user, no external force is applied to the keycap 11 and the rubbery elastomer 13 is no longer pushed by the keycap 11. In response to the elasticity of the rubbery elastomer 13, the rubbery elastomer 13 is restored to its original shape to provide an upward elastic restoring force. Consequently, the keycap 11 is returned to its original position where it is not depressed. The structures and the operations of the conventional key structure have been mentioned as above.

With increasing development of science and technology, the demand on a slim-type keyboard is gradually increased. For example, a slim-type keyboard as shown in FIG. 2 is introduced into the market. FIG. 2 is a schematic side cross-sectional view illustrating another conventional key structure. As shown in FIG. 2, the conventional key structure 2 comprises a keycap 21, a scissors-type connecting element 22, a metallic triggering element 23, a membrane switch circuit member 24 and a base 25. The structures and functions of the keycap 21, the scissors-type connecting element 22, the membrane switch circuit member 24 and the base 25 are substantially identical to those of the corresponding components of the key structure 1, and are not redundantly described herein. In comparison with the key structure 1, the key structure 2 comprises the metallic triggering element 23 in replace of the rubbery elastomer 13.

The metallic triggering element 23 is disposed on the membrane switch circuit member 24. When the metallic triggering element 23 is pushed by the keycap 21, the metallic triggering element 23 is subjected to deformation to push the membrane switch circuit member 24. Consequently, a corresponding key signal is generated. When the keycap 21 is no longer depressed by the user, the deformed metallic triggering element 23 is restored to its original shape to provide an upward pushing force. Consequently, the keycap 21 is returned to its original position where it is not depressed. The metallic triggering element 23 is made of a metallic material. Moreover, the thickness of the metallic triggering element 23 is smaller than the thickness of the rubbery elastomer 13. Consequently, the overall thickness of the conventional key structure 2 is smaller than the overall thickness of the conventional key structure 1. Moreover, a pressing part 211 is disposed on an inner surface of the keycap 21 and aligned with the metallic triggering element 23. The pressing part 211 is integrally formed with the keycap 21. Moreover, both of the pressing part 211 and the keycap 21 are made of a plastic material.

However, since the metallic triggering element 23 is made of a metallic material, some problems may occur. For example, when the keycap 21 is depressed by the user, the metallic triggering element 23 made of the metallic material may adversely affect the tactile feel of the keycap 21.

Therefore, there is a need of providing a key structure with slimness and enhanced tactile feel.

SUMMARY OF THE INVENTION

The present invention provides a key structure with slimness and enhanced tactile feel.

In accordance with an aspect of the present invention, there is provided a key structure. The key structure includes a switch circuit board, a triggering assembly, a keycap and an elastic element. The triggering assembly is disposed over the switch circuit board. The switch circuit board is triggered by the triggering assembly in response to an external force. The keycap is disposed over the triggering assembly. When the external force is applied to the keycap, the keycap is moved. The elastic element is arranged between the keycap and the triggering assembly and contacted with the keycap and the triggering assembly. As the keycap is moved, the triggering assembly is pushed by the elastic element, so that the switch circuit board is triggered. The elastic element includes a concave part. The concave part is located at a top end of the elastic element and contacted with the keycap. When the elastic element is pushed by the keycap, the concave part is subjected to deformation, so that a movable distance of the keycap toward the switch circuit board is increased.

In accordance with another aspect of the present invention, there is provided a key structure. The key structure includes a switch circuit board, a triggering assembly, a keycap and an elastic element. The triggering assembly is disposed over the switch circuit board. The switch circuit board is triggered by the triggering assembly in response to an external force. The keycap is disposed over the triggering assembly. The elastic element is arranged between the keycap and the triggering assembly and contacted with the keycap and the triggering assembly. As the keycap is moved, the triggering assembly is pushed by the elastic element, so that the switch circuit board is triggered. The elastic element includes a pushing part. The pushing part is disposed on an inner surface of the elastic element and continuously contacted with the triggering assembly. When the elastic element is pushed by the keycap, the triggering assembly is pushed by the pushing part.

From the above descriptions, the present invention provides a key structure. The key structure has a triggering assembly in replace of the rubbery elastomer of the conventional key structure. Consequently, the thickness of keyboard with the key structure of the present invention is smaller. That is, the keyboard is slimmer. Moreover, an elastic element made of a soft material is arranged between the keycap and the triggering assembly. When the keycap is depressed by the user, the elastic element is pushed by the keycap and subject to deformation. Under this circumstance, a space for continuously moving the keycap is provided, and the movable distance of the keycap is increased. Consequently, the tactile feel of depressing the keycap is enhanced. Moreover, since the pushing part of the elastic element is continuously contacted with the triggering assembly, the pushing part and the triggering assembly do not collide with each other. In other words, the sound of the key structure caused by collision will be reduced.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

For solving the drawbacks of the conventional technologies, the present invention provides a key structure with enhanced structural strength and slim appearance.

Figure 1:
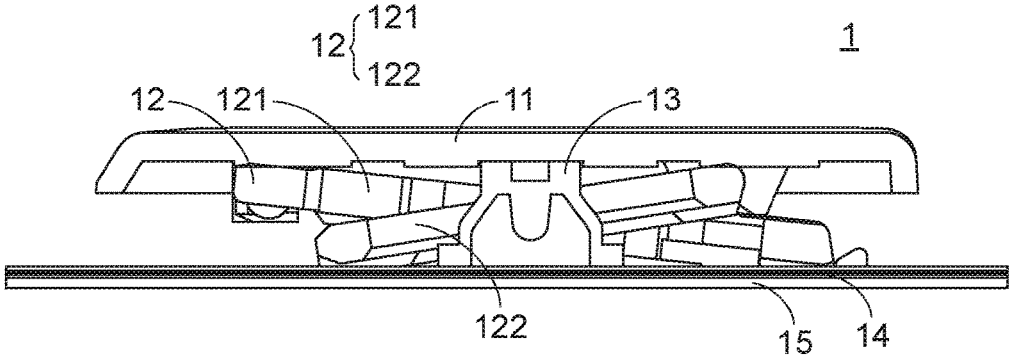
FIG.1 PRIOR ART
FIG. 1 is a schematic side cross-sectional view illustrating a conventional key structure.
Figure 2:
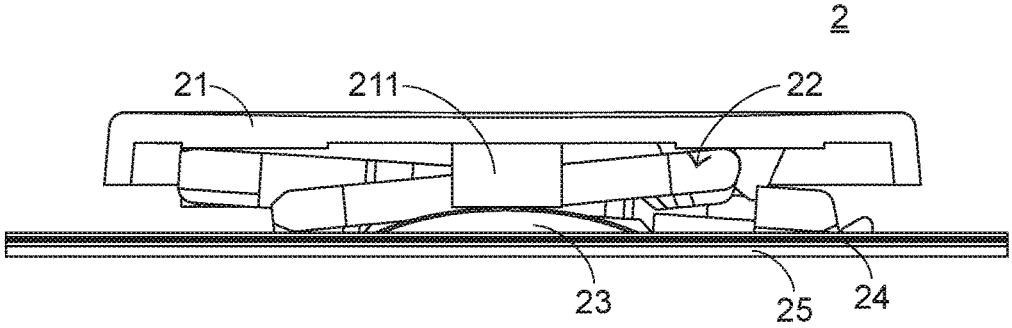
FIG.2 PRIOR ART
FIG. 2 is a schematic side cross-sectional view illustrating another conventional key structure.
Figure 3:
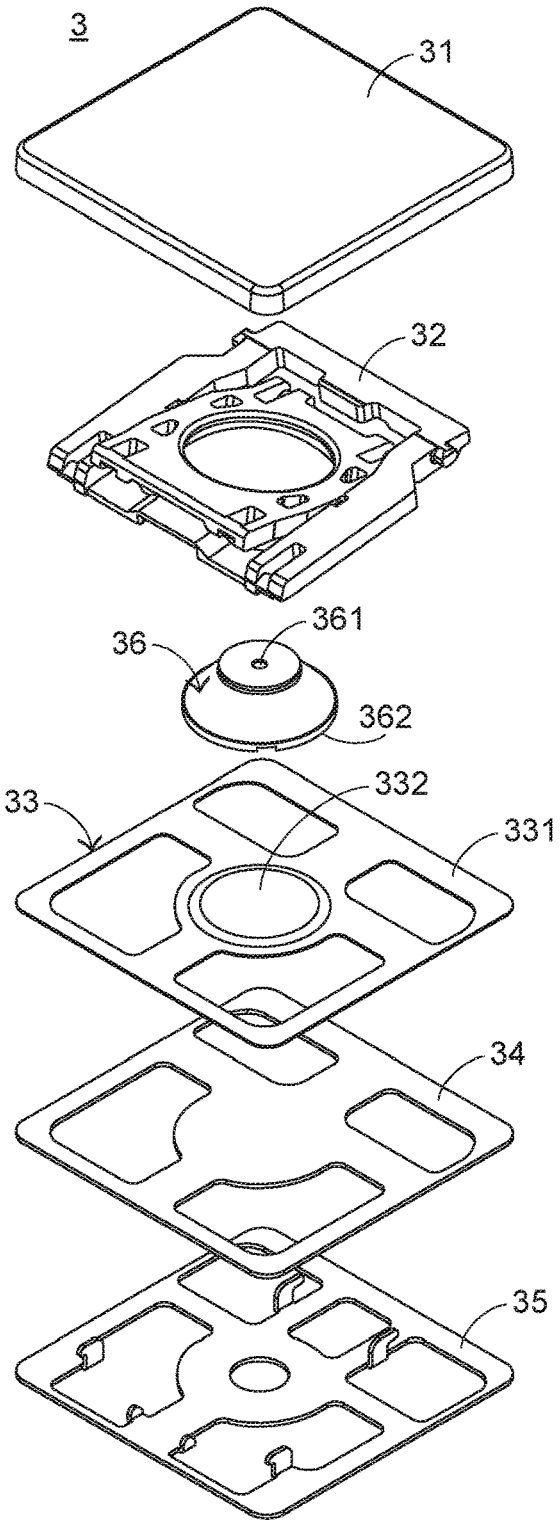
FIG. 3 is a schematic exploded view illustrating a key structure according to a first embodiment of the present invention.
Figure 4:
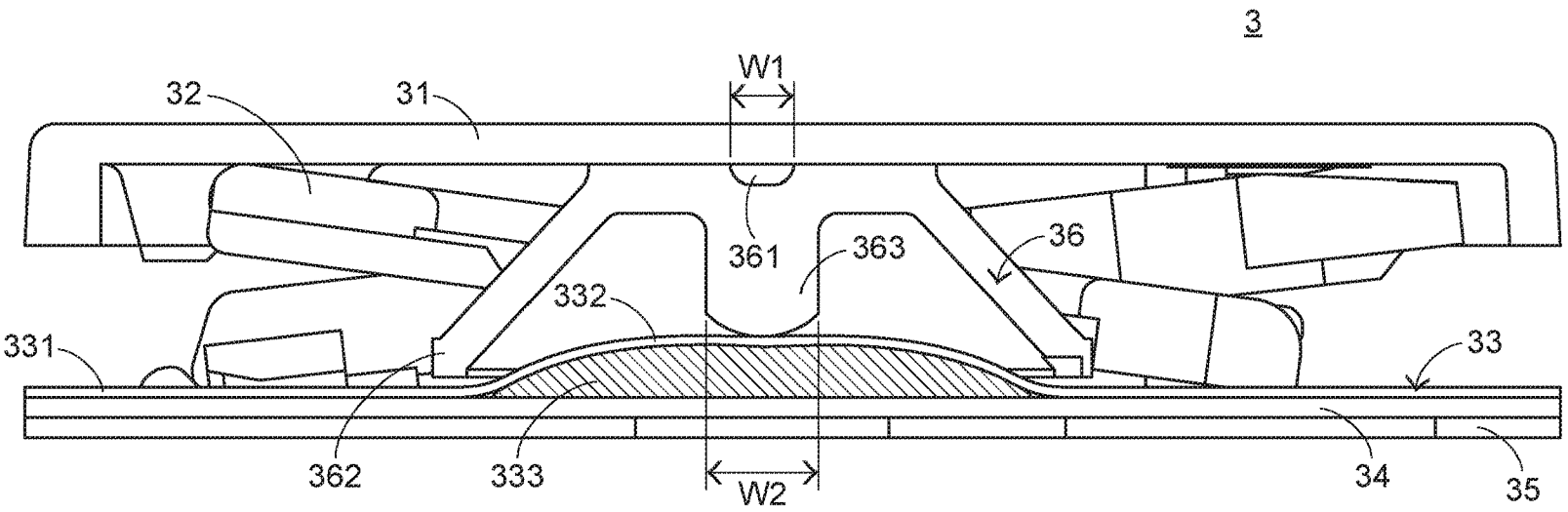
FIG. 4 is a schematic side cross-sectional view illustrating the key structure according to the first embodiment of the present invention, in which the keycap is not depressed.

FIG. 3 is a schematic exploded view illustrating a key structure according to a first embodiment of the present invention. FIG. 4 is a schematic side cross-sectional view illustrating the key structure according to the first embodiment of the present invention. As shown in FIGS. 3 and 4, the key structure 3 comprises a keycap 31, a scissors-type connecting element 32, a triggering assembly 33, a switch circuit board 34, a base 35 and an elastic element 36. The base 35 is connected with the scissors-type connecting element 32. The keycap 31, the scissors-type connecting element 32, the triggering assembly 33 and the switch circuit board 34 are supported by the base 35. The switch circuit board 34 is disposed over the base 35. Moreover, the switch circuit board 34 is disposed under the triggering assembly 33 and contacted with the triggering assembly 33. The switch circuit board 34 has a key intersection (not shown) corresponding to the triggering assembly 33. The triggering assembly 33 over the switch circuit board 34 is inserted into an inner space of the scissors-type connecting element 32. In response to an external force on the triggering assembly 33, the switch circuit board 34 is triggered by the triggering assembly 33. In this embodiment, the switch circuit board 34 is a membrane switch circuit member.

The keycap 31 is connected with the scissors-type connecting element 32, and disposed over the triggering assembly 33. In response to an external force applied to the keycap 31, the keycap 31 is moved upwardly or downwardly relative to the base 35. As the scissors-type connecting element 32 is swung, the keycap 31 is moved upwardly or downwardly relative to the base 35. The elastic element 36 is arranged between the keycap 31 and the triggering assembly 33. The elastic element 36 is contacted with the triggering assembly 33. Moreover, the elastic element 36 is moved upwardly or downwardly with the keycap 31. Consequently, the underlying triggering assembly 33 is pushed by the elastic element 36. Under this circumstance, the switch circuit board 34 is triggered by the triggering assembly 33. In this embodiment, the keycap 31 is made of a plastic material.

The structure of the elastic element 36 will be described as follows. In an embodiment, the elastic element 36 comprises a concave part 361, a supporting part 362 and a pushing part 363. The concave part 361 is located at a top end of the elastic element 36 and contacted with a keycap 31. When the elastic element 36 is pushed by the keycap 31, the concave part 361 is subjected to deformation. Consequently, the movable distance of the keycap 31 toward the switch circuit board 34 is increased. In this context, the movable distance of the keycap 31 is referred as a travelling distance. As the travelling distance of the keycap 31 is increased, the tactile feel of the keycap 31 is enhanced. The supporting part 362 is located at a bottom side of the elastic element 36. Moreover, the supporting part 362 is contacted with the triggering assembly 33. Consequently, the elastic element 36 is fixed on the triggering assembly 33. The pushing part 363 is disposed on an inner surface of the elastic element 36. When the elastic element 36 is pushed by the keycap 31, the triggering assembly 33 is pushed by the pushing part 363. Moreover, the pushing part 363 is continuously contacted with the triggering assembly 33. Regardless of whether the keycap 31 is depressed, the pushing part 363 is contacted with the triggering assembly 33. In this embodiment, the concave part 361, the supporting part 362 and the pushing part 363 are integrally formed, and the elastic element 36 is made of an elastic soft material.

In an embodiment, the triggering assembly 33 comprises a thin plate 331, a covering film 332 and a metallic triggering element 333. The thin plate 331 is disposed on the switch circuit board 34 and contacted with the supporting part 362. The thin plate 331 of the key structure 3 is connected with the thin plate of an adjacent key structure. The covering film 332 is disposed over the thin plate 331 and aligned with the elastic element 36. Moreover, the covering film 332 is contacted with the pushing part 363. The metallic triggering element 333 is covered within the covering film 332. When the triggering assembly 33 is pushed, the metallic triggering element 333 is subjected to deformation. Consequently, the corresponding key intersection of the switch circuit board 34 is pushed by the metallic triggering element 333. In this embodiment, the thin plate 331 and the covering film 332 are integrally formed, and the metallic triggering element 333 is an elastic sheet made of a metallic material.

As shown in FIG. 4, the components of the key structure 3 from top to bottom include the keycap 31, the scissors-type connecting element 32, the triggering assembly 33, the switch circuit board 34 and the base 35 sequentially. Moreover, the elastic element 36 and the triggering assembly 33 are arranged between the keycap 31 and the switch circuit board 34 and enclosed by the scissors-type connecting element 32. The elastic element 36 is disposed over the triggering assembly 33, and contacted with the triggering assembly 33. In an embodiment, at least one of the pushing part 363 and the supporting part 362 is adhered onto the triggering assembly 33. Consequently, the elastic element 36 is fixed on the triggering assembly 33. By this design, the elastic element 36 is not shifted toward the left direction or the right direction in response to the external force while the keycap 31 is depressed.

Figure 5:
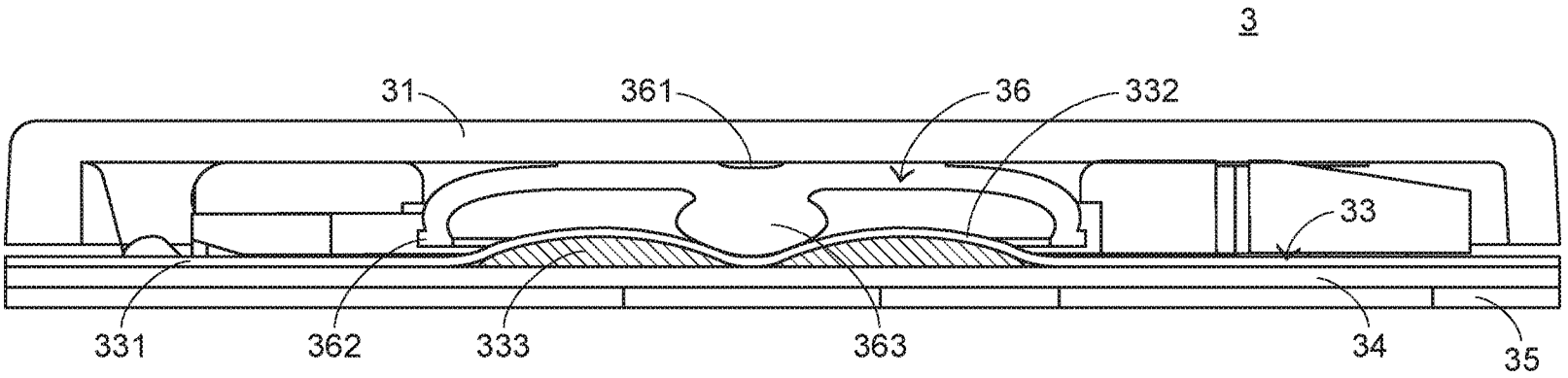
FIG. 5 schematically illustrates the key structure when the keycap is depressed.

After the above components are combined with each other, the key structure 3 as shown in FIG. 4 is assembled. The operations of the key structure 3 in response to the depressing action of the user will be illustrated as follows. FIG. 5 schematically illustrates the key structure 3 when the keycap 31 is depressed. When the keycap 31 is depressed, the keycap 31 is moved downwardly to push the scissors-type connecting element 32 in response to the depressing force. Consequently, the scissors-type connecting element 32 is activated. As the keycap 31 is moved downwardly relative to the base 35, the concave part 361 of the elastic element 36 is pushed by the keycap 31. Consequently, the elastic element 36 is moved downwardly with the keycap 31. Moreover, the covering film 332 of the triggering assembly 33 is pushed by the pushing part 363. At the same time, the metallic triggering element 333 covered within the covering film 332 is subjected to deformation to push the switch circuit board 34 and trigger the corresponding key intersection of the switch circuit board 34. Consequently, the switch circuit board 34 generates a corresponding key signal.

When the keycap 31 is no longer depressed by the user, no external force is applied to the keycap 31 and the covering film 332 and the metallic triggering element 333 are no longer pushed by the pushing part 363. In response to the elasticity of the metallic triggering element 333, the metallic triggering element 333 is restored to its original shape to provide an upward elastic restoring force. In response to the upward elastic restoring force, the keycap 31 is returned to its original position where it is not depressed.

The following two aspects should be specially described. Firstly, while the triggering assembly 33 is pushed by the pushing part 363, the elastic element 36 is compressed between the keycap 31 and the triggering assembly 33 and subjected to deformation because the elastic element 36 is made of the soft material. Consequently, the keycap 31 is moved downwardly for a certain distance continuously. That is, the movable distance of the keycap 31 toward the switch circuit board 34 is increased. The elastic element 36 can be subjected to deformation. Moreover, the concave part 361 at the top end of the elastic element 36 is also subjected to deformation. Since the movable distance of the keycap 31 is increased, the key structure 3 can provide better tactile feel. Moreover, since the pushing part 363 is continuously contacted with the triggering assembly 33, the pushing part 363 and the triggering assembly 33 do not collide with each other. In other words, the sound of the key structure 3 caused by collision will be reduced. Secondly, the width W1 of the concave part 361 may be increased or decreased according to the practical requirements. Consequently, the travelling distance of the keycap 31 is adjustable. As the width W1 of the concave part 361 is increased, the travelling distance of the keycap 31 is increased.

In other words, since the elastic element 36 of the key structure 3 is made of the soft material, the stiff feel caused by the triggering assembly 33 with the metallic material is alleviated. Moreover, since the movable distance of the keycap 31 toward the switch circuit board 34 is increased, the tactile feel of depressing the keycap 31 is enhanced.

Figure 6:
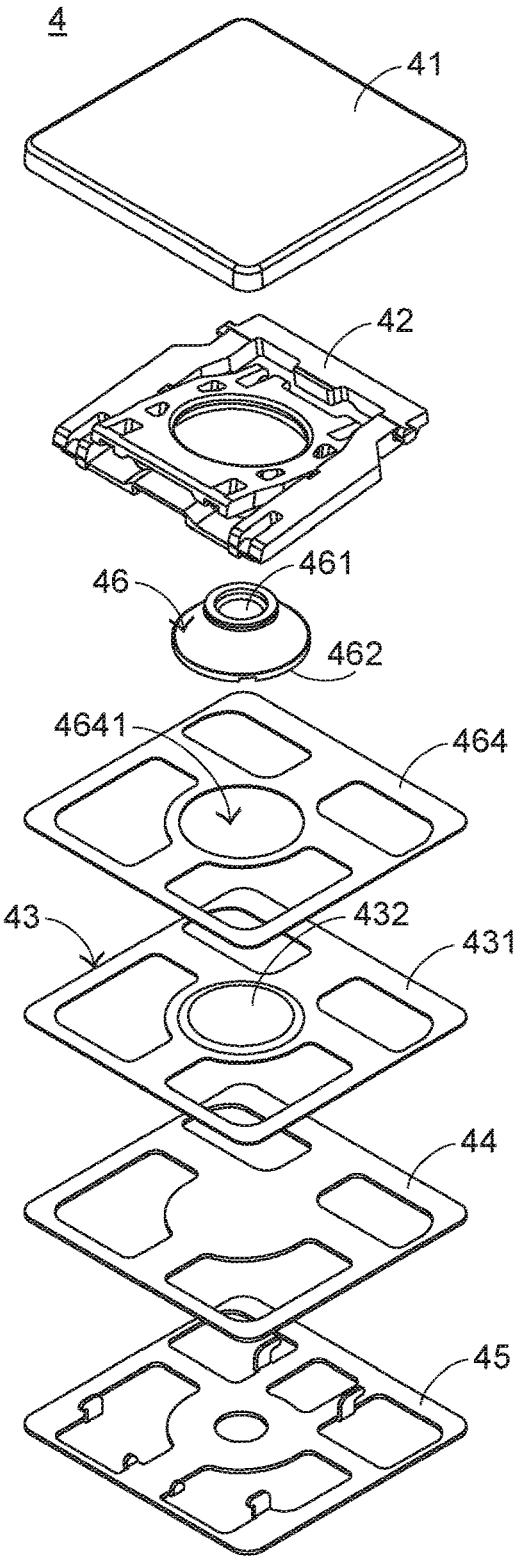
FIG. 6 is a schematic exploded view illustrating a key structure according to a second embodiment of the present invention.
Figure 7:
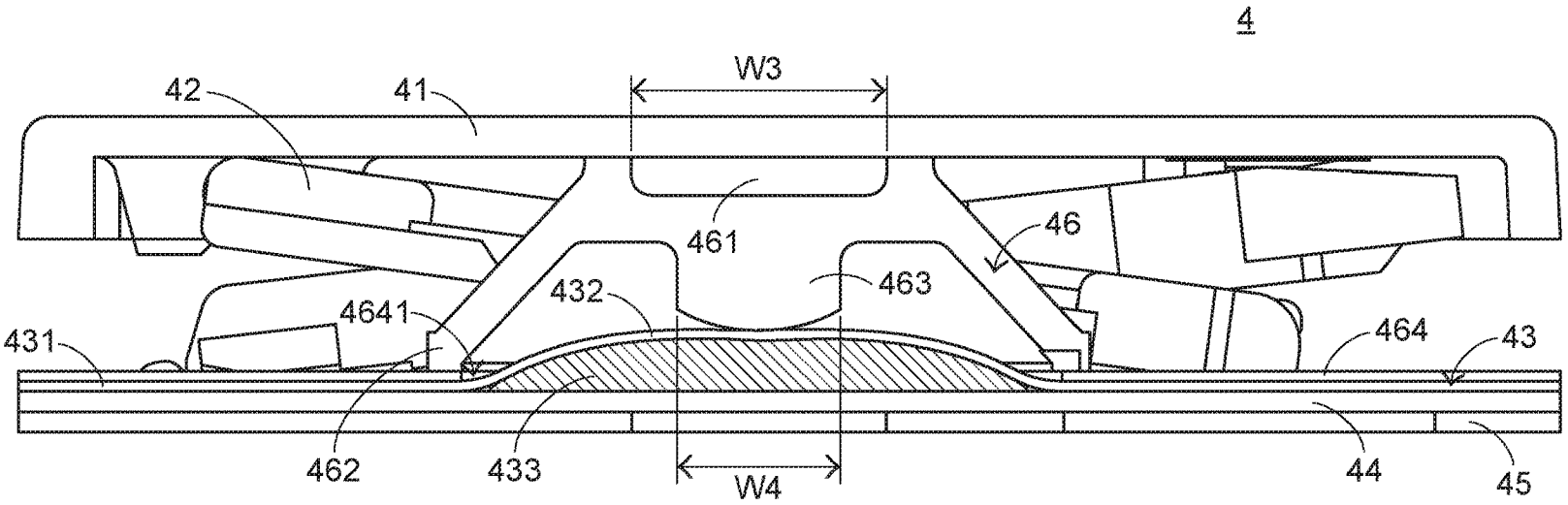
FIG. 7 is a schematic side cross-sectional view illustrating the key structure according to the second embodiment of the present invention.

The present invention further provides a second embodiment, which is distinguished from the first embodiment. FIG. 6 is a schematic exploded view illustrating a key structure according to a second embodiment of the present invention. FIG. 7 is a schematic side cross-sectional view illustrating the key structure according to the second embodiment of the present invention. As shown in FIGS. 6 and 7, the key structure 4 comprises a keycap 41, a scissors-type connecting element 42, a triggering assembly 43, a switch circuit board 44, a base 45 and an elastic element 46. The triggering assembly 43 comprises a thin plate 431, a covering film 432 and a metallic triggering element 433. The structures and functions of the components of the key structure 4 which are identical to those of the first embodiment are not redundantly described herein. In comparison with the first embodiment, the elastic element 46 of the key structure 4 of this embodiment is distinguished.

In this embodiment, the elastic element 46 comprises a concave part 461, a supporting part 462, a pushing part 463 and an elastic film 464. The concave part 461 is located at a top end of the elastic element 46 and contacted with a keycap 41. When the elastic element 46 is pushed by the keycap 41, the concave part 461 is subjected to deformation. Consequently, the travelling distance of the keycap 41 is increased. The supporting part 462 is located at a bottom side of the elastic element 46. Moreover, the supporting part 462 is contacted with the triggering assembly 43. Consequently, the elastic element 46 is fixed on the triggering assembly 43. The pushing part 463 is disposed on an inner surface of the elastic element 46. When the elastic element 46 is pushed by the keycap 41, the triggering assembly 43 is pushed by the pushing part 463. Moreover, the pushing part 463 is continuously contacted with the triggering assembly 43. The elastic film 464 is connected with the supporting part 462. The supporting part 462 and the elastic film 464 are collaboratively contacted with the triggering assembly 43. Consequently, the elastic element 46 is fixed on the triggering assembly 43. The elastic film 464 has an opening 4641. The pushing part 463 is penetrated through the opening 4641 and continuously contacted with the triggering assembly 43.

In this embodiment, the concave part 461, the supporting part 462 and the pushing part 463 are integrally formed. Moreover, the elastic film 464 is adhered onto the pushing part 463. It is noted that numerous modifications and alterations may be made while retaining the teachings of the invention. For example, in another embodiment, the concave part, the supporting part, the pushing part and the elastic film are integrally formed.

The following two aspects should be specially described. Firstly, the width W3 of the concave part 461 of this embodiment is larger according to the practical requirements. That is, the width W3 of the concave part 461 is larger than the width W1 of the concave part 361 of the above embodiment (see FIG. 4). Since the width W3 of the concave part 461 is increased, the deformation extent of the concave part 461 is increased and the travelling distance of the keycap 41 is increased. In other words, the tactile feel of depressing the keycap 41 is enhanced. Secondly, the width W4 of the pushing part 463 is larger according to the practical requirement. That is, the width W4 of the pushing part 463 is larger than the width W2 of the pushing part 363 of the above embodiment (see FIG. 4). Since the width of the pushing part 463 is increased, the contact area between the pushing part 463 and the triggering assembly 43 is increased. Consequently, while the elastic element 46 is subjected to deformation, the pushing part 463 is not slid relative to the triggering assembly 43. Under this circumstance, the possibility of causing collision between the pushing part 463 and the triggering assembly 43 is reduced.

From the above descriptions, the present invention provides a key structure. The key structure has a triggering assembly in replace of the rubbery elastomer of the conventional key structure. Consequently, the thickness of keyboard with the key structure of the present invention is smaller. That is, the keyboard is slimmer. Moreover, an elastic element made of a soft material is arranged between the keycap and the triggering assembly. When the keycap is depressed by the user, the elastic element is pushed by the keycap and subject to deformation. Under this circumstance, a space for continuously moving the keycap is provided, and the movable distance of the keycap is increased. Consequently, the tactile feel of depressing the keycap is enhanced. Moreover, since the pushing part of the elastic element is continuously contacted with the triggering assembly, the pushing part and the triggering assembly do not collide with each other. In other words, the sound of the key structure caused by collision will be reduced.

While the invention has been described in terms of what is presently considered to be the most practical and preferred embodiments, it is to be understood that the invention needs not be limited to the disclosed embodiments. On the contrary, it is intended to cover various modifications and similar arrangements included within the spirit and scope of the appended claims which are to be accorded with the broadest interpretation so as to encompass all modifications and similar structures.

What is claimed is:

1. A key structure, comprising:

a switch circuit board;

a triggering assembly disposed over the switch circuit board, wherein the switch circuit board is triggered by the triggering assembly in response to an external force;

a keycap disposed over the triggering assembly, wherein when the external force is applied to the keycap, the keycap is moved; and an elastic element arranged between the keycap and the triggering assembly and contacted with the keycap and the triggering assembly, wherein as the keycap is moved, the triggering assembly is pushed by the elastic element, so that the switch circuit board is triggered, wherein the elastic element comprises a concave part, and the concave part is located at a top end of the elastic element and contacted with the keycap, wherein when the elastic element is pushed by the keycap, the concave part is subjected to deformation, so that a movable distance of the keycap toward the switch circuit board is increased;

wherein the elastic element further comprises:

a supporting part located at a bottom side of the elastic element, wherein the supporting part is contacted with the triggering assembly, so that the elastic element is fixed on the triggering assembly; and a pushing part disposed on an inner surface of the elastic element, wherein when the elastic element is pushed by the keycap, the triggering assembly is pushed by the pushing part, wherein the pushing part is continuously contacted with the triggering assembly.

2. The key structure according to claim 1, wherein at least one of the pushing part and the supporting part is adhered onto the triggering assembly, so that the elastic element is fixed on the triggering assembly.

3. The key structure according to claim 1, wherein the triggering assembly comprises:

a thin plate disposed on the switch circuit board and contacted with the supporting part;

a covering film disposed over the thin plate, aligned with the elastic element, and contacted with the pushing part; and a metallic triggering element covered within the covering film, wherein when the elastic element is pushed, the covering film is compressed and the metallic triggering element is subjected to deformation, wherein when the external force is not applied to the keycap, the metallic triggering element is restored to an original shape and provides an elastic restoring force to the elastic element.

4. The key structure according to claim 1, wherein the elastic element further comprises an elastic film, wherein the elastic film is connected with the supporting part, and the supporting part and the elastic film are collaboratively contacted with the triggering assembly, so that the elastic element is fixed on the triggering assembly, wherein the elastic film has an opening, and the pushing part is penetrated through the opening and continuously contacted with the triggering assembly.

5. The key structure according to claim 1, further comprising:

a base, wherein the switch circuit board and the triggering assembly are supported by the base; and a scissors-type connecting element connected with the keycap and the base, wherein the elastic element is inserted into an inner space of the scissors-type connecting element, wherein as the scissors-type connecting element is swung, the keycap is moved relative to the base.

6. A key structure, comprising:

a switch circuit board;

a triggering assembly disposed over the switch circuit board, wherein the switch circuit board is triggered by the triggering assembly in response to an external force;

a keycap disposed over the triggering assembly, wherein when the external force is applied to the keycap, the keycap is moved; and an elastic element arranged between the keycap and the triggering assembly and contacted with the keycap and the triggering assembly, wherein as the keycap is moved, the triggering assembly is pushed by the elastic element, so that the switch circuit board is triggered, wherein the elastic element comprises a pushing part, and the pushing part is disposed on an inner surface of the elastic element and continuously contacted with the triggering assembly, wherein when the elastic element is pushed by the keycap, the triggering assembly is pushed by the pushing part;

wherein the elastic element further comprises:

a concave part located at a top end of the elastic element and contacted with the keycap, wherein when the elastic element is pushed by the keycap, the concave part is subjected to deformation, so that a movable distance of the keycap toward the switch circuit board is increased; and a supporting part located at a bottom side of the elastic element, wherein the supporting part is contacted with the triggering assembly, so that the elastic element is fixed on the triggering assembly.

7. The key structure according to claim 6, wherein at least one of the pushing part and the supporting part is adhered onto the triggering assembly, so that the elastic element is fixed on the triggering assembly.

8. The key structure according to claim 6, wherein the triggering assembly comprises:

a thin plate disposed on the switch circuit board and contacted with the supporting part;

a covering film disposed over the thin plate, aligned with the elastic element, and contacted with the pushing part; and a metallic triggering element covered within the covering film, wherein when the elastic element is pushed, the covering film is compressed and the metallic triggering element is subjected to deformation, wherein when the external force is not applied to the keycap, the metallic triggering element is restored to an original shape and provides an elastic restoring force to the elastic element.

9. The key structure according to claim 6, wherein the elastic element further comprises an elastic film, wherein the elastic film is connected with the supporting part, and the supporting part and the elastic film are collaboratively contacted with the triggering assembly, so that the elastic element is fixed on the triggering assembly, wherein the elastic film has an opening, and the pushing part is penetrated through the opening and continuously contacted with the triggering assembly.

10. The key structure according to claim 6, further comprising:

a base, wherein the switch circuit board and the triggering assembly are supported by the base; and a scissors-type connecting element connected with the keycap and the base, wherein the elastic element is inserted into an inner space of the scissors-type connecting element, wherein as the scissors-type connecting element is swung, the keycap is moved relative to the base.

* * * * *